US009598911B2

(12) United States Patent
Uhlenberg et al.

(10) Patent No.: US 9,598,911 B2
(45) Date of Patent: Mar. 21, 2017

(54) CORING TOOLS AND RELATED METHODS

(71) Applicant: Baker Hughes Incorporated, Houston, TX (US)

(72) Inventors: Thomas Uhlenberg, Niedersachsen (DE); Volker Richert, Celle/Gross-Hehlen (DE)

(73) Assignee: Baker Hughes Incorporated, Houston, TX (US)

( * ) Notice: Subject to any disclaimer, the term of this patent is extended or adjusted under 35 U.S.C. 154(b) by 299 days.

(21) Appl. No.: 14/274,495

(22) Filed: May 9, 2014

(65) Prior Publication Data

US 2015/0322722 A1 Nov. 12, 2015

(51) Int. Cl.

| | |
|---|---|
| ***E21B 10/60*** | (2006.01) |
| ***E21B 10/02*** | (2006.01) |
| ***E21B 10/46*** | (2006.01) |
| ***E21B 25/12*** | (2006.01) |
| ***E21B 25/00*** | (2006.01) |
| ***E21B 10/54*** | (2006.01) |

(52) U.S. Cl.

CPC ..... *E21B 10/605* (2013.01); *E21B 10/02* (2013.01); *E21B 10/46* (2013.01); *E21B 10/54* (2013.01); *E21B 25/00* (2013.01); *E21B 25/12* (2013.01)

(58) Field of Classification Search

CPC ..... E21B 10/605; E21B 10/02; E21B 10/48; E21B 25/12

See application file for complete search history.

(56) References Cited

U.S. PATENT DOCUMENTS 4,551,758 A * 11/1985 Masunaga ..... E21B 10/605 257/217
4,981,183 A * 1/1991 Tibbitts ..... E21B 10/48 175/244
5,460,230 A * 10/1995 Dekoster ..... E21B 10/605 175/393
5,568,838 A 10/1996 Struthers et al.
(Continued)

OTHER PUBLICATIONS

International Search Report for International Application No. PCT/US2015029902, dated Aug. 12, 2015, 3 pages.
(Continued)

*Primary Examiner* — Shane Bomar
(74) *Attorney, Agent, or Firm* — TraskBritt

(57) ABSTRACT

A coring bit for extracting a sample of subterranean formation material from a well bore may include a bit body having a bit face and an inner surface defining a substantially cylindrical cavity of the bit body. A first portion of the inner surface may be configured to surround a core catcher. The coring bit may include a face discharge channel inlet formed in the inner surface of the bit body longitudinally at or above the first portion of the inner surface. The coring bit may also include a face discharge channel extending through the bit body from the face discharge channel inlet to the bit face. A tubular body having a core catcher may be disposed in the coring bit to form a coring tool. Methods of forming such bit bodies may include forming an inlet for a face discharge channel in the inner surface of the bit body at a location longitudinally at or above the first portion of the inner surface and forming a face discharge channel extending from the inlet to the bit face.

20 Claims, 6 Drawing Sheets

(56) References Cited

U.S. PATENT DOCUMENTS

| | | | | |
|---|---|---|---|---|
| 6,394,196 | B1 | 5/2002 | Fanuel et al. | |
| 7,055,626 | B2 | 6/2006 | Wells et al. | |
| 7,776,256 | B2 | 8/2010 | Smith et al. | |
| 7,802,495 | B2 | 9/2010 | Oxford et al. | |
| 8,459,381 | B2 * | 6/2013 | Pearce | E21B 10/02 175/403 |
| 2007/0261886 | A1 * | 11/2007 | Wilson | E21B 10/02 175/58 |
| 2010/0089660 | A1 * | 4/2010 | Pearce | E21B 10/02 175/403 |
| 2013/0146366 | A1 | 6/2013 | Cheng et al. | |
| 2014/0216826 | A1 * | 8/2014 | Pearce | E21B 10/605 175/403 |
| 2015/0267492 | A1 * | 9/2015 | Broussard, Jr. | E21B 4/02 175/107 |

OTHER PUBLICATIONS

International Written Opinion for International Application No. PCT/US2015029902, dated Aug. 12, 2015, 8 pages.

* cited by examiner

CORING TOOLS AND RELATED METHODS

FIELD

The present disclosure relates generally to apparatus and methods for taking core samples of subterranean formations. More specifically, the present disclosure relates to a core bit having features to control flow of drilling fluid into a narrow annulus between the core bit inside diameter and the outside diameter of an associated core shoe of a coring apparatus for reduction in drilling fluid contact with, and potential invasion and contamination of, a core being cut.

BACKGROUND

Formation coring is a well-known process in the oil and gas industry. In conventional coring operations, a core barrel assembly is used to cut a cylindrical core from the subterranean formation and to transport the core to the surface for analysis. Analysis of the core can reveal invaluable data concerning subsurface geological formations—including parameters such as permeability, porosity, and fluid saturation—that are useful in the exploration for and production of petroleum, natural gas, and minerals. Such data may also be useful for construction site evaluation and in quarrying operations.

A conventional core barrel assembly typically includes an outer barrel having, at a bottom end, a core bit adapted to cut the cylindrical core and to receive the core in a central opening, or throat. The opposing end of the outer barrel is attached to the end of a drill string, which conventionally comprises a plurality of tubular sections that extends to the surface. Located within, and releasably attached to, the outer barrel is an inner barrel assembly having an inner tube configured for retaining the core. The inner barrel assembly further includes a core shoe disposed at one end of the inner tube adjacent the throat of the core bit. The core shoe is configured to receive the core as it enters the throat and to guide the core into the inner tube. Both the inner tube and core shoe are suspended within the outer barrel with structure permitting the core bit and outer barrel to rotate freely with respect to the inner tube and core shoe, which remain rotationally stationary. Thus, as the core is cut—by application of weight to the core bit through the outer barrel and drill string in conjunction with rotation of these components—the core will traverse the throat of the core bit to eventually reach the rotationally stationary core shoe, which accepts the core and guides it into the inner tube assembly where the core is retained until transported to the surface for examination.

Conventional core bits are generally comprised of a bit body having a face surface on a bottom end. The opposing end of the core bit is configured, as by threads, for connection to the outer barrel. Located at the center of the face surface is the throat, which extends into a hollow cylindrical cavity formed in the bit body. The face surface includes a plurality of cutters arranged in a selected pattern. The pattern of cutters includes at least one outside gage cutter disposed near the periphery of the face surface that determines the diameter of the borehole drilled in the formation. The pattern of cutters also includes at least one inside gage cutter disposed near the throat that determines the outside diameter of the core being cut.

During coring operations, a drilling fluid is usually circulated through the core barrel assembly to lubricate and cool the plurality of cutters disposed on the face surface of the core bit and to remove formation cuttings from the bit face surface to be transported upwardly to the surface through the annulus defined between the drill string and the wall of the well bore. A typical drilling fluid, also termed drilling "mud," may be a hydrocarbon or water base in which fine-grained mineral matter is suspended. The core bit includes one or more ports or nozzles positioned to deliver drilling fluid to the face surface. Generally, a port includes a port outlet, or "face discharge outlet," which may optionally comprise a nozzle, at the face surface in fluid communication with a face discharge channel. The face discharge channel extends through the bit body and terminates at a face discharge channel inlet. Each face discharge channel inlet is in fluid communication with an upper annular region formed between the bit body and the inner tube and core shoe. Drilling fluid received from the drill string under pressure is circulated into the upper annular region to the face discharge channel inlet of each face discharge channel to draw drilling fluid from the upper annular region. Drilling fluid then flows through each face discharge channel and discharges at its associated face discharge port to lubricate and cool the plurality of cutters on the face surface and to remove formation cuttings as noted above.

In conventional core barrel assemblies, a narrow annulus exists in the region between the inside diameter of the bit body and the outside diameter of the core shoe. The narrow annulus is essentially an extension of the upper annular region and, accordingly, the narrow annulus is in fluid communication with the upper annular region. Thus, in addition to flowing into the face discharge channel inlets, the pressurized drilling fluid circulating into the upper annular region also flows into the narrow annulus between the bit body and core shoe, also referred to as a "throat discharge channel." The location at which drilling fluid bypasses the face discharge channel inlets and continues into the throat discharge channel is commonly referred to as the "flow split." The throat discharge channel terminates at the entrance to the core shoe proximate the face of the core bit and any drilling fluid flowing within its boundaries is exhausted proximate the throat of the core bit. As a result, drilling fluid flowing from the throat discharge channel will contact the exterior surface of the core being cut as the core traverses the throat and enters the core shoe.

Prior art core barrel assemblies are prone to damage core samples in various ways during operation. For example, a significant length of the core shoe may extend longitudinally below a core catcher housed within the core shoe. After the core catcher engages the core, withdrawal of the core barrel assembly from the well bore often causes the core to fracture at a location just below the core catcher instead of at the bottom of the well bore, leaving a stump of core material within the well bore. This stump may be problematic for several reasons. For example, this stump may dislocate the core catcher, cause the core barrel assembly to jam, or otherwise interfere with a smooth withdrawal of the core sample from the well bore. Moreover, the stump represents a portion of the core sample that was not recovered and delivered to the surface, resulting in a potential loss of valuable information regarding the formation material within the well bore. Additionally, the stump may interfere with subsequent operations within the well bore, such as drilling, reaming, or additional coring operations.

Another way in which prior art core barrel assemblies damage core samples is by exposing the core to deleterious amounts of drilling fluid. For example, a throat discharge channel having a high Total Flow Area ("TFA"), measured in a plane transverse to a longitudinal axis of the core barrel assembly, can create significant problems during coring operations, especially when coring in relatively soft to medium hard formations, or in unconsolidated formations. Drilling fluids discharged from the throat discharge channel enter an unprotected interval where no structure stands between such drilling fluids and the outer surface of the core as the core traverses the throat and enters the core shoe. Such drilling fluid can invade and contaminate the core itself. For soft or unconsolidated formations, these drilling fluids invading the core may wash away, or otherwise severely disturb, the material of the core. The core may be so badly damaged by the drilling fluid invasion that standard tests for permeability, porosity, and other characteristics produce unreliable results, or cannot be performed at all. The severity of the negative impact of the drilling fluid on the core increases with the velocity of the drilling fluid in the unprotected interval. Fluid invasion of unconsolidated or fragmented cores is a matter of great concern in the petroleum industry as many hydrocarbon-producing formations, such as sand and limestone, are of the unconsolidated type. For harder formations, drilling fluid coming into contact with the core may still penetrate the core, contaminating the core and making it difficult to obtain reliable test data. Thus, limiting fluid invasion of the core can greatly improve core quality and recoverability while yielding a more reliable characterization of the drilled formation.

The problems associated with stump length and fluid invasion of core samples described above may be a result, at least in part, of the material comprising the bit body of a core barrel assembly. Conventional core bits often comprise hard particulate materials (e.g., tungsten carbide) dispersed in a metal matrix (commonly referred to as "metal matrix bits"). Metal matrix bits have a highly robust design and construction necessitated by the severe mechanical and chemical environments in which the core bit must operate. However, the dimensional tolerances of metal matrix core bits (including inner surface diameter, gap width of the throat discharge channel, TFA of the face discharge channels and depth of the junk slots) are severely limited by the strength of the metal matrix material. In such metal matrix core bits, portions of the bit body must exceed a minimal thickness necessary to maintain structural integrity and inhibit the formation of cracks or microfractures therein.

BRIEF SUMMARY

In some embodiments, a coring tool for extracting a sample of subterranean formation material from a well bore comprises a tubular body disposed within a bit body, a portion of the tubular body housing a core catcher. The tubular body and the bit body define a fluid flow path therebetween. The coring tool includes at least one face discharge channel extending through the bit body from a face discharge channel inlet to a face of the bit body. The face discharge channel inlet is in fluid communication with the fluid flow path and is located longitudinally at or above the core catcher.

In other embodiments, a coring bit for extracting a sample of subterranean formation material from a well bore includes a bit body having a bit face and an inner surface that defines a substantially cylindrical cavity of the bit body. A first portion of the inner surface is configured to surround a core catcher. At least one face discharge channel inlet is formed in the inner surface of the bit body longitudinally at or above the first portion of the inner surface. At least one face discharge channel extends through the bit body from the at least one face discharge channel inlet to the bit face.

In still other embodiments, a method of forming a coring bit for extracting a sample of subterranean formation material from a well bore comprises providing a bit body having a bit face and an inner surface, the inner surface defining a substantially cylindrical cavity of the bit body. A first portion of the inner surface is configured to surround a core catcher. The method includes forming at least one inlet of a face discharge channel in the inner surface of the bit body at a location longitudinally at or above the first portion of the inner surface. The method also includes forming at least one face discharge channel extending through the bit body from the at least one inlet to the bit face.

BRIEF DESCRIPTION OF THE DRAWINGS

While the disclosure concludes with claims particularly pointing out and distinctly claiming specific embodiments, various features and advantages of embodiments of the disclosure may be more readily ascertained from the following description when read in conjunction with the accompanying drawings, in which:

DETAILED DESCRIPTION

Figure 1:
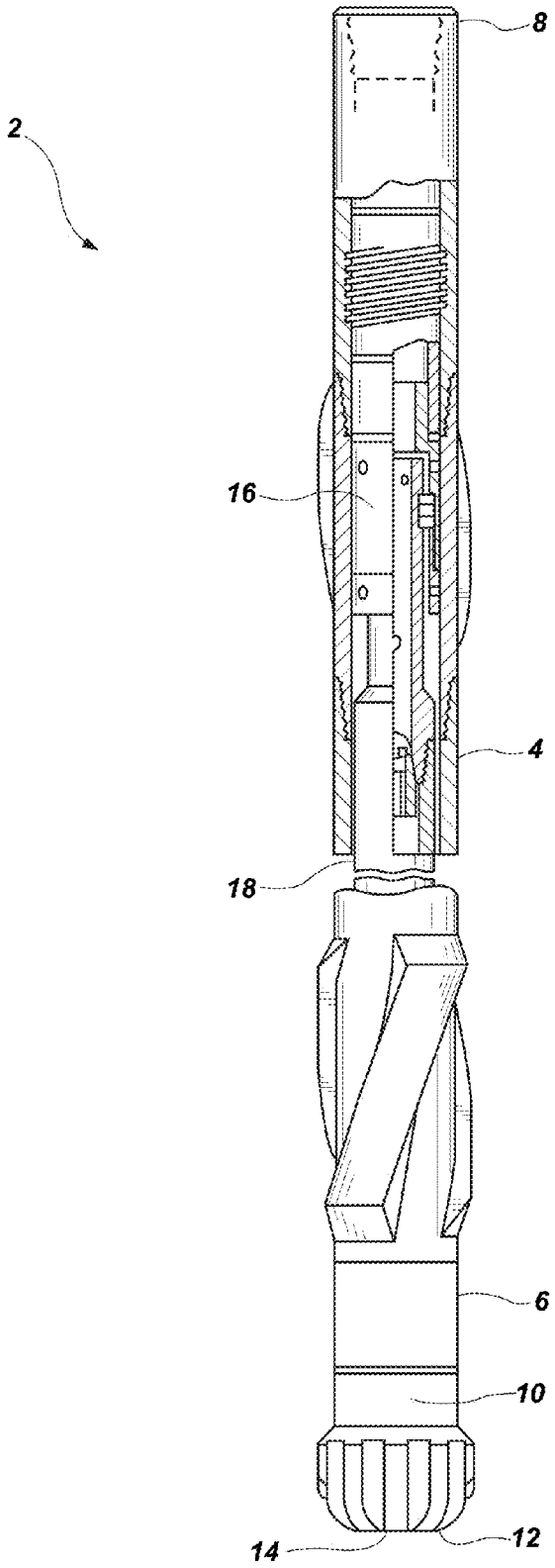
FIG. 1 illustrates a side, partially cut away plan view of a core barrel assembly for cutting a core sample from a subterranean formation.

The illustrations presented herein are not meant to be actual views of any particular core bit or shoe of a coring tool, or component thereof, but are merely idealized representations employed to describe illustrative embodiments. Thus, the drawings are not necessarily to scale.

The disclosures of any and all references cited herein are incorporated herein in their entireties by this reference for all purposes. Further, the cited reference(s), regardless of how characterized herein, is not admitted as prior art relative to the invention of the subject matter claimed herein.

As used herein, directional terms, such as "above"; "below"; "up"; "down"; "upward"; "downward"; "top"; "bottom"; "top-most" and "bottom-most," are to be interpreted from a reference point of the object so described as such object is located in a vertical well bore, regardless of the actual orientation of the object so described. For example, the terms "above"; "up"; "upward"; "top" and "top-most" are synonymous with the term "uphole," as such term is understood in the art of subterranean well bore drilling. Similarly, the terms "below"; "down"; "downward"; "bottom" and "bottom-most" are synonymous with the term "downhole," as such term is understood in the art of subterranean well bore drilling.

As used herein, the term "longitudinal" refers to a direction parallel to a longitudinal axis of the core barrel assembly. For example, a "longitudinal" cross-section shall mean a cross-section viewed in a plane extending along the longitudinal axis of the core barrel assembly.

As used herein, the terms "lateral"; "laterally"; "transverse" or "transversely" shall mean "transverse to a longitudinal axis of the core barrel assembly. For example, a "lateral" or "transverse" cross-section shall mean a cross-section viewed in a plane transverse to the longitudinal axis of the core barrel assembly.

Disclosed herein are embodiments of a core barrel assembly with increased effectiveness at reducing the core stump length. Also disclosed herein are embodiments of a core barrel assembly with increased effectiveness at reducing exposure of the core to drilling fluid. Decreasing the amount and/or velocity of drilling fluid contacting the core sample may be accomplished by decreasing hydraulic losses, such as fluid flow resistance (also termed "head loss" or "resistance head") within the face discharge channels and increasing hydraulic losses within the throat discharge channel. Hydraulic losses of the various channels are at least partly a function of the TFA along those channels. Thus, as set forth more fully in the embodiments disclosed below, the hydraulic losses of the throat discharge channel may be increased by reducing the TFA or otherwise increasing the fluid flow resistance of the throat discharge channel as much as possible. Increasing the hydraulic losses of the throat discharge channel may result in an increase in drilling fluid bypassing the throat discharge channel and instead flowing through the face discharge channels and away from the core. Such management of the hydraulic losses of the throat discharge channel may also reduce the velocity of drilling fluid exiting the throat discharge channel relative to prior art core bits. The maximum TFA of the face discharge channels is limited by the radial space of the bit body and the need to maintain minimum wall thicknesses within the bit body to prevent cracks or microfractures from foaming therein. Additionally, the minimum TFA of the throat discharge channel is limited because a sufficient radial gap between an inner surface of the core bit and an outer surface of the core shoe is necessary to allow the core bit to rotate with respect to the core shoe without catching or binding therewith. Embodiments of a core barrel assembly that optimize fluid management therein by decreasing the TFA of the throat discharge channel and/or increasing flow restriction within the throat discharge channel are set forth below.

FIG. 1 illustrates a core barrel assembly 2. The core barrel assembly 2 may include an outer barrel 4 having a core bit 6 disposed at a bottom end thereof. The end 8 of the outer barrel 4 opposite the core bit 6 may be configured for attachment to a drill string (not shown). The core bit 6 includes a bit body 10 having a face surface 12. The face surface 12 of the core bit 6 may define a central opening, or throat 14, that extends into the bit body 10 and is adapted to receive a core (not shown) being cut.

The bit body 10 may comprise steel or a steel alloy, including a maraging steel alloy (i.e., an alloy comprising iron alloyed with nickel and secondary alloying elements such as aluminum, titanium and niobium), and may be formed at least in part as further set forth in U.S. Patent Publication No. 2013/0146366 A1, published Jun. 6, 2013, to Cheng et al., the disclosure of which is incorporated herein in its entirety by this reference. In other embodiments, the bit body 10 may be an enhanced metal matrix bit body, such as, for example, a pressed and sintered metal matrix bit body as disclosed in one or more of U.S. Pat. No. 7,776,256, issued Aug. 17, 2010, to Smith et al. and U.S. Pat. No. 7,802,495, issued Sep. 28, 2010, to Oxford et al., the disclosure of each of which is incorporated herein in its entirety by this reference. Such an enhanced metal matrix bit body may comprise hard particles (e.g., ceramics such as oxides, nitrides, carbides, and borides) embedded within a continuous metal alloy matrix phase comprising a relatively high strength metal alloy (e.g., an alloy based on one or more of iron, nickel, cobalt, and titanium). As a non-limiting example, such an enhanced metal matrix bit body may comprise tungsten carbide particles embedded within an iron-, cobalt-, or nickel-based alloy. However, it is to be appreciated that the bit body 10 may comprise other materials as well, and any bit body material is within the scope of the embodiments disclosed herein.

Removably disposed inside the outer barrel 4 may be an inner barrel assembly 16. The inner barrel assembly 16 may include an inner tube 18 adapted to receive and retain a core for subsequent transportation to the surface. The inner barrel assembly 16 may further include a core shoe (not shown in FIG. 1) that may be disposed adjacent the throat 14 for receiving the core and guiding the core into the inner tube 18. The core shoe is discussed in more detail below. The core barrel assembly 2 may have other features not shown or described with reference to FIG. 1, which have been omitted for clarity and ease of understanding. Therefore, it is to be understood that the core barrel assembly 2 may include many features in addition to those shown in FIG. 1.

Figure 2:
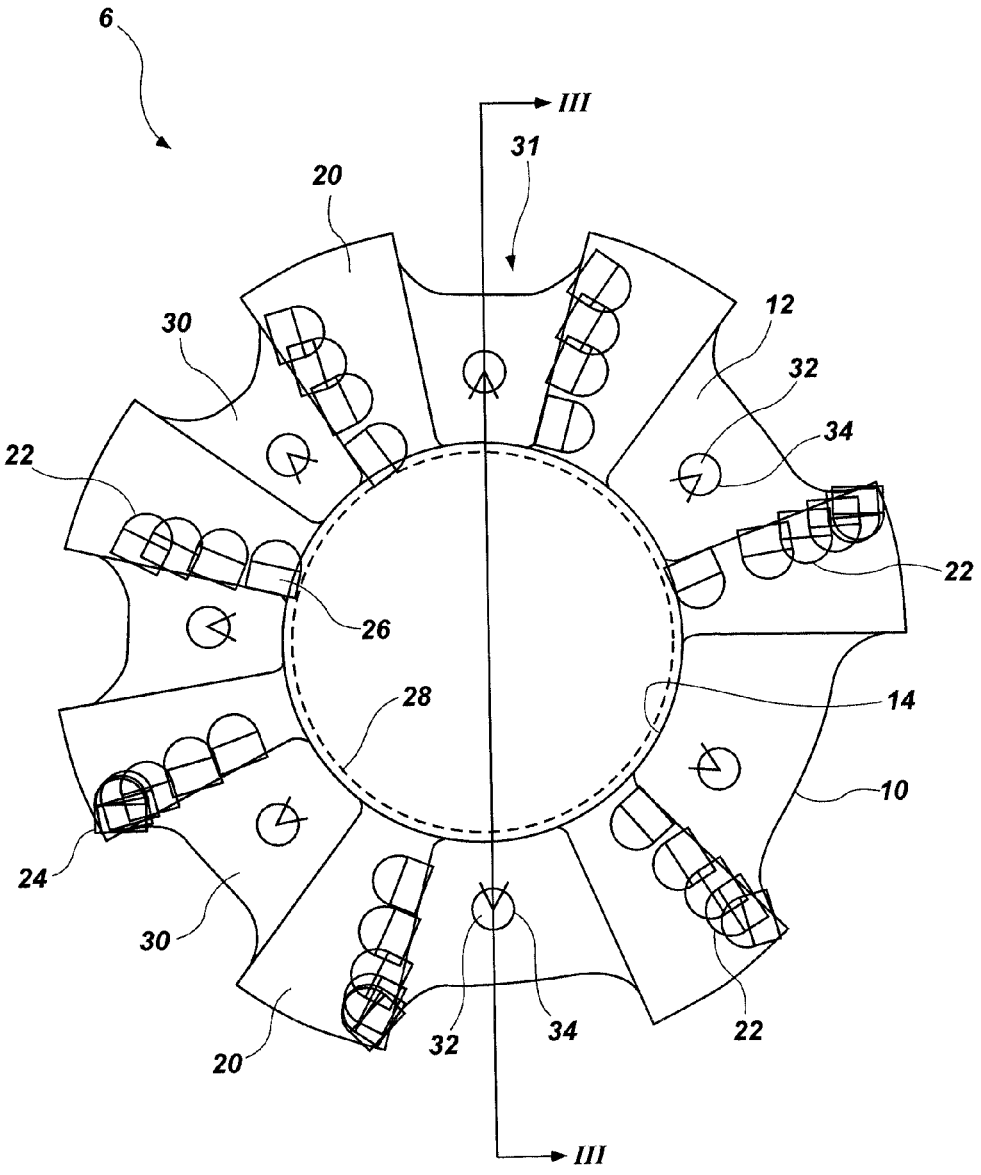
FIG. 2 illustrates a bottom, face view of a core bit of the core barrel assembly of FIG. 1.
Figure 3:
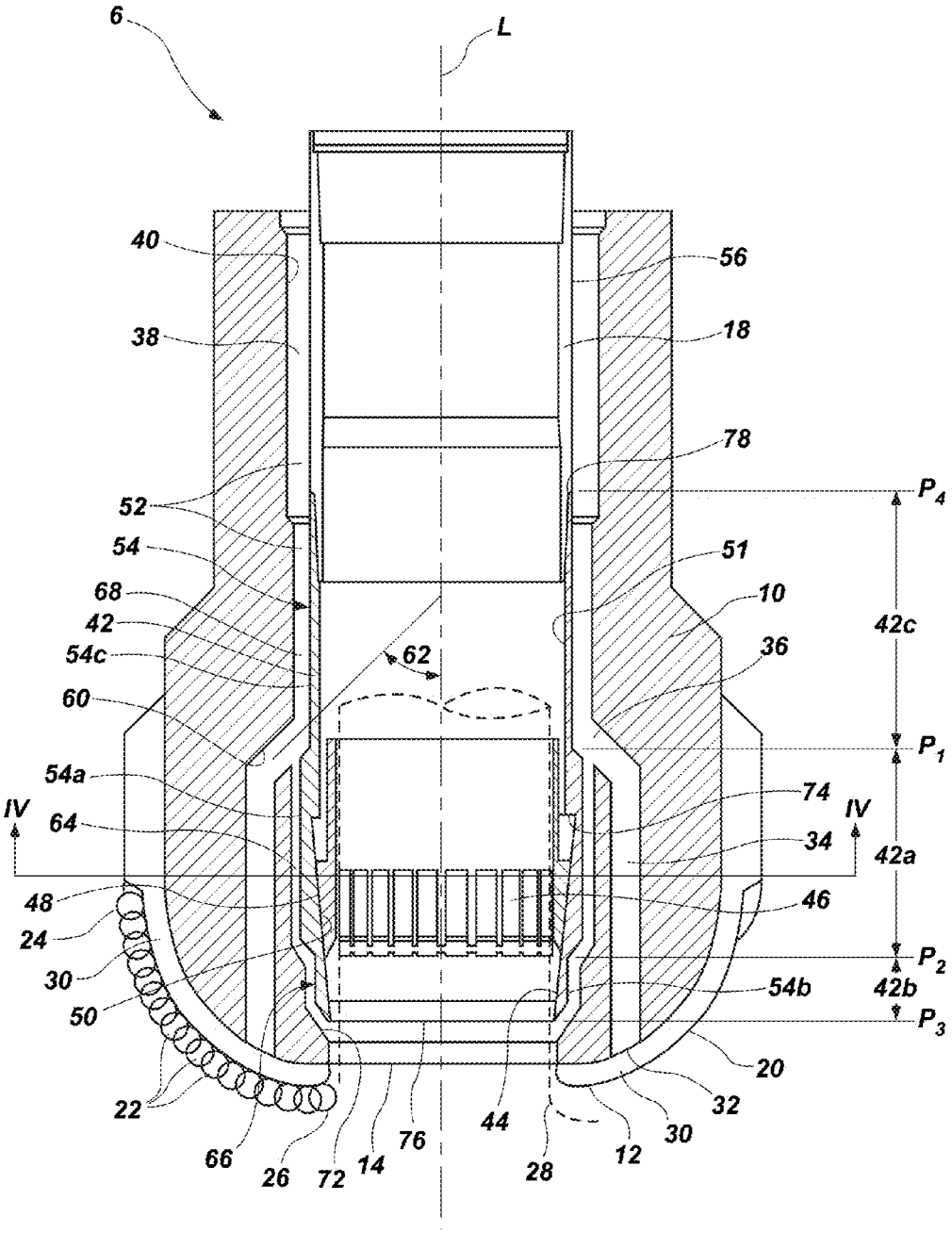
FIG. 3 illustrates a cross-sectional view of the core bit and associated core shoe and inner tube of FIGS. 1 and 2, taken along line of FIG. 2, according to an embodiment of the present disclosure.
Figure 4:
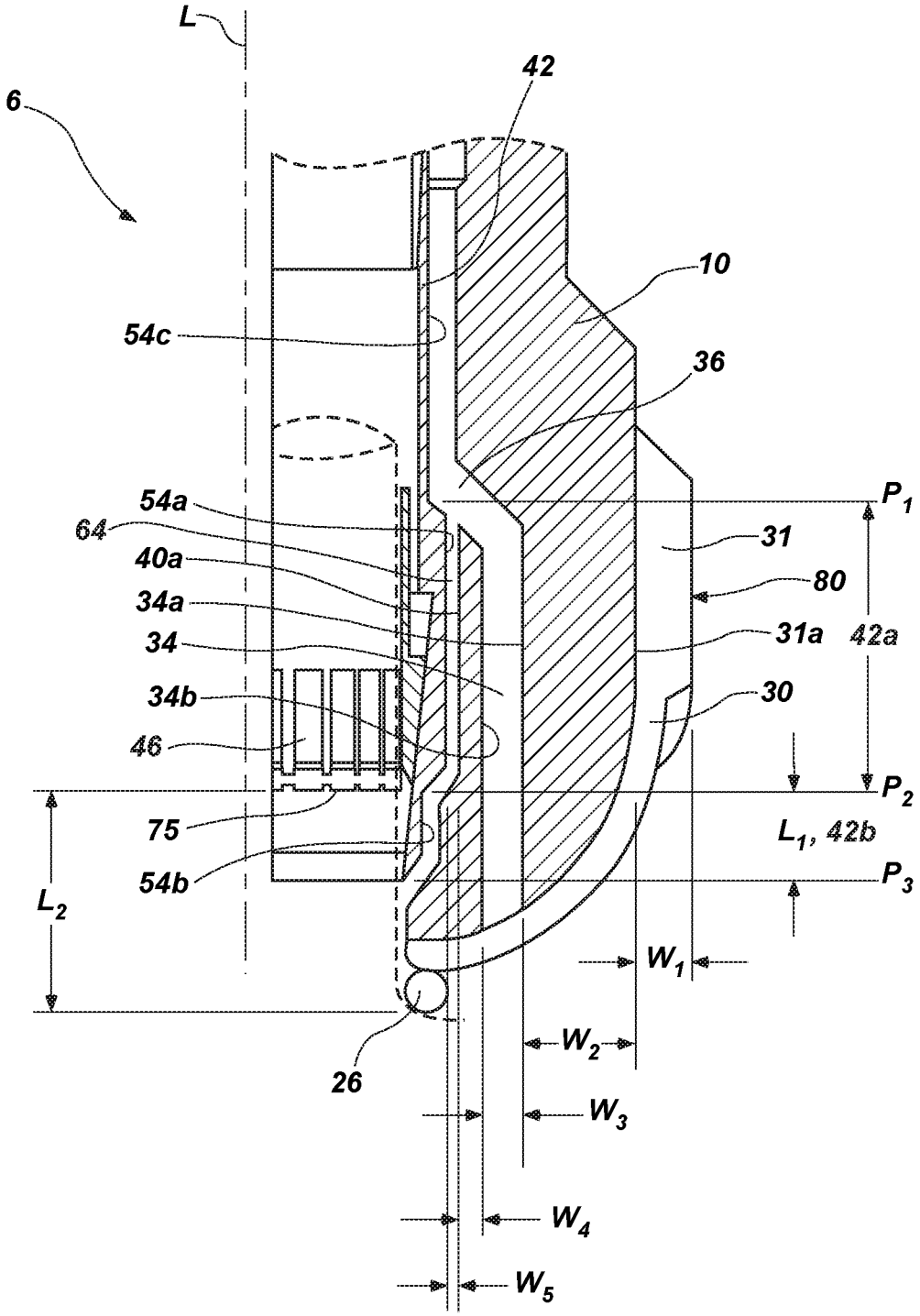
FIG. 4 illustrates a partial longitudinal cross-sectional view of the core bit and associated core shoe of FIG. 3.
Figure 5:
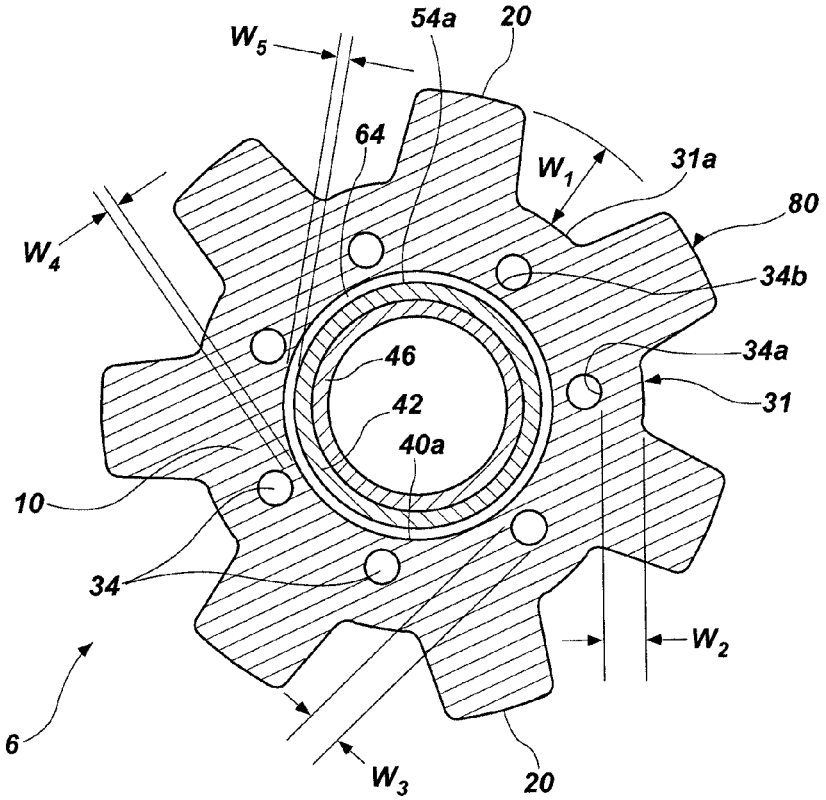
FIG. 5 illustrates a lateral cross-sectional view of the core bit and associated core shoe of FIG. 4, taken along line IV-IV of FIG. 3.

FIGS. 2-5 show additional views of the core bit 6 depicted in FIG. 1. FIG. 2 is a bottom view of the core bit 6; FIGS. 3 and 4 show longitudinal cross-sectional views of the core bit 6 as taken along line of FIG. 2; and FIG. 5 shows a transverse cross-sectional view of the core bit 6 at taken along line IV-IV of FIG. 3.

As can be seen in FIG. 2, the throat 14 may open into the bit body 10 at the face surface 12. The bit body 10 may include a plurality of blades 20 at the face surface 12. A plurality of cutters 22 may be attached to the blades 20 and arranged in a selected pattern. The pattern of cutters 22—shown rotationally superimposed one upon another along the bit profile in FIG. 3—may include at least one outside gage cutter 24 that determines the diameter of the borehole cut in the formation. The pattern of cutters 22 may also include at least one inside gage cutter 26 that determines the diameter of a core 28 (shown by the dashed line) being cut and entering the throat 14.

Radially extending fluid passages 30 may be formed on the face surface 12 between successive blades 20, which fluid passages 30 are contiguous with associated junk slots 31 on the gage of the core bit 6 between the blades 20. The face surfaces of the fluid passages 30 may be recessed relative to the blades 20. The bit body 10 may further include one or more face discharge outlets 32 for delivering drilling fluid to the face surface 12 to lubricate the cutters 22 during a coring operation. Each face discharge outlet 32 is in fluid communication with a face discharge channel 34 extending from the face discharge outlet 32 through the bit body 10 and inwardly terminating at a face discharge channel inlet 36 (see FIG. 3).

The bit body 10 may have an inner, substantially cylindrical cavity 38 extending longitudinally therethrough and bounded by an inner surface 40 of the bit body 10. The throat 14 opens into the inner substantially cylindrical cavity 38. The inner tube 18 may extend into the inner, substantially cylindrical cavity 38 of the bit body 10. A core shoe 42 may be disposed at the lower end of the inner tube 18. The core shoe 42 may be a single component or may consist of more than one part. As shown, the core shoe 42 may be a separate body coupled to the inner tube 18. However, in other embodiments, the core shoe 42 and the inner tube 18 may be integrally formed together. The inner tube 18 and the core shoe 42 may each be in the form of a tubular body, and each may be suspended so that the core bit 6 and outer barrel 4 (FIG. 1) may freely rotate about the inner tube 18 and the core shoe 42. The core shoe 42 may have a central bore 44 configured and located to receive the core 28 therein as the core 28 traverses the throat 14 and to guide the core 28 into the inner tube 18. The core shoe 42 may be hardfaced to increase its durability.

A core catcher 46 may be housed within the central bore 44 of the core shoe 42. The core catcher 46 may comprise, for example, a wedging collet structure located within the core shoe 42. The core catcher 46 may be sized and shaped to enable the core 28 to pass through the core catcher 46 when traveling longitudinally upward into the inner tube 18. When the core barrel assembly 2 begins to back out of the well bore, the outer surface of wedge-shaped portion 48 of the core catcher 46 comprising a number of circumferentially spaced collet fingers may interact with a tapered portion 50 of an inner surface 51 of the core shoe 42 to cause the collet fingers to constrict around and frictionally engage with the core 28, reducing (e.g., eliminating) the likelihood that the core 28 will exit the inner tube 18 after it has entered therein and enabling the core 28 to be fractured under tension from the formation from which the core 28 has been cut. The core 28 may then be retained in the inner tube 18 until the core 28 is transported to the surface for analysis.

An annular region 52 of the core barrel assembly 2 is located between the inner surface 40 of the bit body 10 and outer surfaces 54, 56 of the core shoe 42 and the inner tube 18, respectively. An outer surface 54*a* of the core shoe 42 surrounding the wedge-shaped portion 48 of the core catcher 46 may have a diameter greater than a diameter of an outer surface 54*b* of the core shoe 42 located downward of the wedge-shaped portion 48 of the core catcher 46 to ensure sufficient wall thickness of the core shoe 42. During a coring operation, drilling fluid is circulated under pressure into the annular region 52 such that drilling fluid can flow into the inlet 36 of each face discharge channel 34. The drilling fluid then flows through the face discharge channel 34 and is discharged at the face discharge channel outlet 32 on the face surface 12. Each face discharge channel inlet 36 may have a shape 60 that is generally cylindrical and of a constant diameter; however, non-cylindrical shapes including irregular shapes may also be possible. The face discharge channel inlet 36 may further be oriented at an angle of approach 62 relative to the flow path extending down from the annular region 52. In the embodiment shown in FIG. 3, the angle of approach 62 is approximately 45 degrees. However, the angle of approach 62 may be adjusted to increase the hydrodynamic efficiency and manage respective hydraulic losses of the face discharge channel inlet 36, the face discharge channels 34, and/or the throat discharge channel 64.

A narrow annulus 64, also referred to as a "throat discharge channel," may be between the inner surface 40 of the bit body 10 located below the face discharge channel inlet 36 and the outer surface 54 of the core shoe 42. The throat discharge channel 64 is essentially a smaller volume extension of, and in fluid communication with, the annular region 52. The throat discharge channel 64 includes a boundary profile 66 that defines the shape of the flow path in the throat discharge channel 64. Disposed proximate the face discharge channel inlets 36 is an annular reservoir 68 between the adjacent inner surface 40 of the bit body 10 and the outer surface 54 of the core shoe 42. Drilling fluid circulating into the annular region 52 collects in the annular reservoir 68, where the drilling fluid can feed into the face discharge channel inlets 36 for delivery to the face surface 12. As shown in FIG. 3, the annular region 52 and the annular reservoir 68 may be continuous with one another without any substantial flow restrictions therebetween. However, in other embodiments, the annular region 52 and the annular reservoir 68 may be distinct, separate annular regions, wherein the annular reservoir 68 is located below the annular region 52. For example, in such alternative embodiments, the annular region 52 and the annular reservoir 68 may be separated from one another by a portion of the bit body 10 extending radially inward in a manner to restrict flow between the annular region 52 and the annular reservoir 68.

Drilling fluid circulating in the annular region 52 and collecting in the annular reservoir 68 will also flow into the throat discharge channel 64. Drilling fluid entering the throat discharge channel 64 will flow therethrough and exit the throat discharge channel 64 through an annular gap 72 proximate the throat 14. A longitudinal interval measured from a lower-most end 76 of the core shoe 42 to a longitudinal midpoint of the inside gage cutter 26 may be termed an "unprotected interval" of the throat 14 because, once the drilling fluid has passed the lower-most end 76 of the core shoe 42, no structure stands between the drilling fluid and the core sample 28. Thus, in the unprotected interval, drilling fluid exiting the throat discharge channel 64 may contact, and thereby invade and contaminate, the core 28 as the core 28 traverses the throat 14 and enters the core shoe 42.

As shown in FIG. 3, a first portion 42*a* of the core shoe 42 may at least substantially house the wedge-shaped portion 48 of the core catcher 46. The first portion 42*a* of the core shoe 42 may be located longitudinally between a first longitudinal point $P_1$ and a second longitudinal point $P_2$. The first longitudinal point $P_1$ may be located longitudinally upward of a shoulder 74 of the inner surface 51 of the core shoe 42, wherein the shoulder 74 may be contiguous with the tapered portion 50 of the inner surface 51 of the core shoe 42. Additionally, the second longitudinal point $P_2$ may be longitudinally located below the first longitudinal point $P_1$ and may correspond to a longitudinal location of the boundary between the outer surface 54*a* of the core shoe 42 surrounding the wedge-shaped portion 48 of the core catcher 46 and the outer surface 54*b* of the core shoe 42 located substantially downward of the wedge-shaped portion 48 of the core catcher 46 and having a narrower diameter in relation to outer surface 54*a*. The second longitudinal point $P_2$ may also be located above a third longitudinal point $P_3$ corresponding to the lower-most end 76 of the core shoe 42. Moreover, a fourth longitudinal point $P_4$ may correspond to an upper-most end 78 of the core shoe 42. The portion of the core shoe 42 located longitudinally between the second and third longitudinal points $P_2$, $P_3$ may be said to be a second portion 42*b* of the core shoe 42; and the portion of the core shoe 42 located longitudinally between the fourth and first longitudinal points $P_4$, $P_1$ may be said to be a third portion 42*c* of the core shoe 42. The first portion 42*a* of the core shoe 42 may have an outer surface 54*a* with a diameter greater than diameters of outer surfaces 54*b*, 54*c* of the second and third portions 42*b*, 42*c* of the core shoe 42, respectively, to ensure sufficient wall thickness of the core shoe 42. Thus, the first portion 42*a* of the core shoe 42 may be said to be a "wider portion" of the core shoe 42 relative to the second and third portions 42*b*, 42*c* of the core shoe 42. The wider portion 42*a* of the core shoe 42 may accommodate the wedge-shaped portion 48 of the core catcher 46 and at least a portion of the tapered portion 50 of the inner surface 51 of the core shoe 42.

The face discharge channel inlets 36 may be located longitudinally at or above the first longitudinal point $P_1$. Stated differently, the face discharge channel inlet 36 may be located longitudinally above the first portion 42*a* of the core shoe 42. Stated yet another way, the face discharge channel inlets 36 may be located longitudinally above the widest portion of the core shoe 42. In prior art core barrel assemblies, the flow split is conventionally located at a narrow portion of the core shoe relative to the portion housing the core catcher, which narrow portion is longitudinally downward of the core catcher. This is so because the strength limitations of conventional metal matrix bit bodies requires greater thicknesses between features of the bit body to prevent cracks or microfractures from forming in the bit body during use. In such prior art core bits, locating the flow split longitudinally at or above the wider portion of the core shoe would cause the throat discharge channel and face discharge channels to occupy too much of the remaining radial space of the bit body, leading to the formation of cracks or microfractures therein. Furthermore, in such prior art core bits, the wider portion of the core shoe (i.e., the portion housing the core catcher) was located upward relative to the position of the first portion 42*a* of the core shoe 42 shown in FIG. 3 so that a narrower portion of the prior art core shoe extending downward to the bottom end thereof would occupy less radial space as the outer diameter of the core bit narrowed at the bit face, thus providing the necessary minimum wall thicknesses on either radial side of the face discharge channels proximate the bit face to prevent the formation of cracks or microfractures in the bit body. Thus, in such prior art core bits, the core shoe included a longer narrow portion below the portion housing the core catcher, resulting in a longer stump of core material left within the well bore than left by the core bits of this disclosure, as for fully described below.

With continued reference to FIG. 3, it is to be appreciated that, in other embodiments (not shown), the diameter of the outer surface 54*b* of the second portion 42*b* of the core shoe 42 may be equivalent to the diameter of the outer surface 54*a* of the first portion 42*a* of the core shoe. In yet other embodiments (not shown), the diameter of the outer surface 54*c* of the third portion 42*c* of the core shoe 42 may be equivalent to the diameter of the outer surface 54*a* of the first portion 42*a* of the core shoe 42. In such embodiments, the outer surface 54*a* of the first portion 42*a* of the core shoe 42 and either of the second and third portions 42*b*, 42*c* of the core shoe 42 having a diameter equivalent to the diameter of the first portion 42*a* may together be said to be the "wider portion" of the core shoe 42 relative to the other of the second and third portions 42*b*, 42*c* of the core shoe 42. In yet further embodiments (not shown), the diameters of the outer surfaces 54*a*, 54*b*, 54*c* of the first, second and third portions 42*a*, 42*b*, 42*c* of the core shoe 42 may each be substantially equivalent (i.e., the core shoe 42 may have substantially a single, consistent outer diameter along the entire longitudinal length of the core shoe 42). It is to be appreciated that in such embodiments, each of the first, second and third portions 42*a*, 42*b*, 42*c* of the core shoe 42 may be said to be the "wider" portion of the core shoe 42.

The core bit 6 may have many other features not shown in FIGS. 2 and 3 or described in relation thereto, as some aspects of the core bit 6 may have been omitted from the text and figures for clarity and ease of understanding. Therefore, it is to be understood that the core bit 6 may include many features in addition to those shown in FIGS. 2 and 3. Furthermore, it is to be further understood that the core bit 6 may not contain all of the features herein described.

FIGS. 4 and 5 show a partial longitudinal cross-sectional view and a lateral cross-sectional view, respectively, of the core bit 6 of FIG. 3, illustrating dimensions of various elements of the core bit 6, the core shoe 42, and the core barrel assembly 2 of FIG. 1, according to an embodiment of the present disclosure. The core bit 6 may have a gage diameter 80 in the range of about 15.9 cm to about 38.1 cm. The junk slots 31 may have a depth $W_1$ measured transversely from the gage portion 80 of the blades 20 to a radial inward-most surface 31*a* of the junk slots 31. A portion of the core bit 6 measured transversely from a radial inward-most surface 31*a* of the junk slots 31 to a radially outward-most surface 34*a* of the face discharge channels 34 may have a radial width $W_2$. The face discharge channels 34 may have a maximum radial width $W_3$. A portion of the core bit 6 measured radially from a radially inward-most surface 34*b* of the face discharge channels 34 to a radially inward-most surface 40*a* of the core bit 6 at a longitudinal location corresponding to the wider portion 42*a* of the core shoe 42 may have a radial width $W_4$. The throat discharge channel 64 may have a radial width $W_5$ measured from the radially inward-most surface 40*a* of the core bit 6 (at a longitudinal location corresponding to the wider portion 42*a* of the core bit 42) to the outer surface 54*a* of the first portion 42*a* of the core shoe 42.

To prevent the formation of cracks or microfractures in the bit body 10, the radial width $W_2$ of the portion between the radial inward-most surface 31*a* of the junk slots 31 and the radially outward-most surface 34*a* of the face discharge channels 34, as well as the radial width $W_4$ of the portion between the radially inward-most surface 34*b* of the face discharge channels 34 and the radially inward-most surface 40*a* of the core bit 6 at the longitudinal location corresponding to the wider portion 42*a* of the core shoe 42, may exceed a minimum thickness that depends upon factors such as, by way of non-limiting example, material composition and design of the bit body, the method(s) of forming the bit body, the subterranean formation material in which the bit body is used, and other operational constraints.

Referring to FIG. 4, the second portion 42*b* of the core shoe 42 may have a length $L_1$ greater than about 7.5 cm measured longitudinally from the second longitudinal point $P_2$ to the third longitudinal point $P_3$. In other embodiments, the length $L_1$ of the second portion 42*b* of the core shoe 42 may be about 7.5 cm or less. In additional embodiments, the length $L_1$ of the second portion 42*b* of the core shoe 42 may be less than about 2.0 cm. In yet additional embodiments, the length $L_1$ of the second portion 42*b* of the core shoe 42 may be less than about 0.5 cm. In further embodiments, the lowermost end of the core shoe 42 may be located at the second longitudinal point $P_2$ (i.e., the length $L_1$ of the second portion 42*b* of the core shoe 42 may be reduced to zero).

The length $L_1$ of the second portion 42*b* of the core shoe 42 may be shorter relative to that found in prior art core shoes. This reduced length $L_1$ of the second portion 42*b* of the core shoe 42 is made possible, at least in part, by locating the face discharge channel inlet 36 to the face discharge channels 34 longitudinally at or above the first portion 42*a* of the core shoe 42. As the stump length often correlates with the length $L_1$ of the second portion 42*b* of the core shoe 42, the reduced length $L_1$ of the second portion 42*b* of the core shoe 42 may result in a shorter core stump left in the well bore. For example, as the core barrel assembly 2, with the core 28 retained in the inner tube 18 and the core shoe 42 by the core catcher 46, begins to be withdrawn from the well bore, the core 28 tends to fracture at a location immediately below the core catcher 46. Thus, the stump length $L_2$ may be measured, in most instances, longitudinally from a bottom surface 75 of the core catcher 46 to a bottom-most edge of the inside gage cutter 26. In the embodiment shown in FIG. 4, the stump length $L_2$ may be considerably shorter than the stump length produced by prior art core bits.

Figure 6:
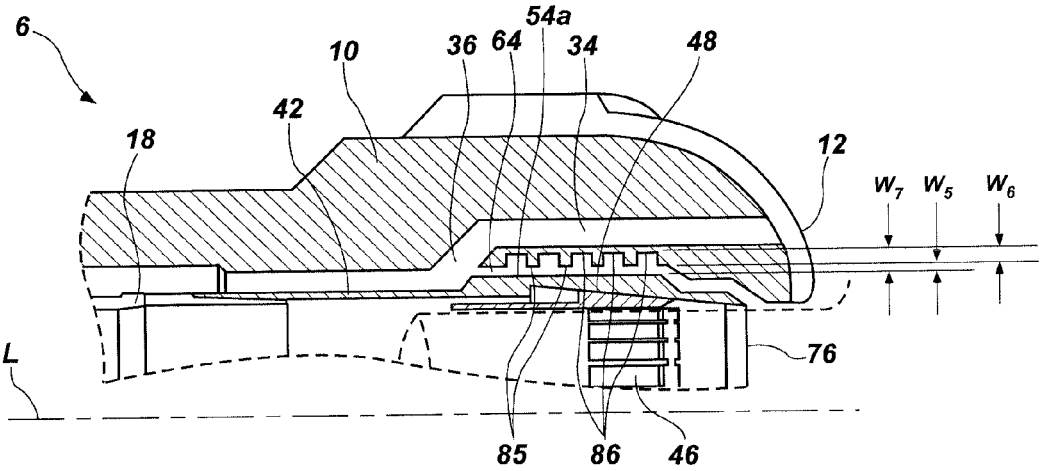
FIG. 6 illustrates a partial longitudinal cross-sectional view of a core bit and associated core shoe, according to an additional embodiment of the present disclosure.

FIG. 6 illustrates a partial cross-section view of a core bit and associated core shoe according to an additional embodiment of the present disclosure. One or more of the outer surface 54*a* of the core shoe 42 surrounding the wedge-shaped portion 48 of the core catcher 46 and an inner surface 85 of the core bit body 10 located within the throat discharge channel 64 may define a series of consecutive TFA changes, also termed "stages," in the throat discharge channel 64. Each stage of the series of consecutive TFA changes in the throat discharge channel 64 may have a TFA, measured in a plane transverse to the longitudinal axis L of the core barrel assembly 2, different than that of the immediately preceding and immediately succeeding stages in the direction of fluid flow through the throat discharge channel 64. In the embodiment shown in FIG. 6, the series of consecutive TFA changes are in the form of a plurality of recesses 86 formed in the inner surface 85 of the core bit body 10 located within the throat discharge channel 64. Each of the recesses 86 may be formed to extend annularly at least partly about a circumference of the inner surface 85 of the bit body 10 located within the throat discharge channel 64. However, it is to be understood that the recesses 86 may take other forms, shapes and configurations, as described in more detail below. With continued reference to FIG. 6, the recesses 86 may have a radial depth $W_6$ measured from a radially outward-most surface of the recesses 86 to the inner surface 85 of the bit body 10 located between adjacent recesses 86. The radial depth $W_6$ of the recesses 86 may be predetermined according to a number of factors, including, by way of non-limiting example, desired flow characteristics of drilling fluid through the throat discharge channel 64, material composition of the bit body 10 and the radial wall thickness $W_4$ of the bit body 10 between the face discharge channel 34 and the throat discharge channel 64. As with the embodiment illustrated in FIGS. 4 and 5, a radial gap $W_5$ of the throat discharge channel 64 outside of the recesses 86, measured from the outer diameter of the outer surface 54*a* of the first portion 42*a* of the core shoe 42 to the inner surface 85 of the bit body 10, may be tailored according to a number of factors, including, by way of non-limiting example, the composition and/or quality of the drilling fluid and rotational velocity of the core bit 6. A radial gap $W_7$ of the throat discharge channel 64 within the recesses 86, measured from the outer diameter of the outer surface 54*a* of the first portion 42*a* of the core shoe 42 to the radially outward-most surface of the recesses 86, may be equivalent to the sum of $W_5$ and $W_6$, and may be tailored according to a number of factors including, by way of non-limiting example, the composition and/or quality of the drilling fluid and rotational velocity of the core bit 6. Thus, a TFA of the throat discharge channel 64 within the recesses 86 is greater than a TFA of the throat discharge channel 64 outside of the recesses 86.

With continued reference to FIG. 6, drilling fluid diverted into the throat discharge channel 64 will encounter the stages as it flows through the throat discharge channel 64. For example, the drilling fluid will encounter stages at which the TFA therein increases (within the recesses 86) and decreases (between adjacent recesses 86). The consecutive stages also have the effect of causing the drilling fluid to repeatedly contract and expand, inducing swirl, and thus increasing the tortuosity of the drilling fluid and increasing the length of the flow path taken by the drilling fluid as it flows through the throat discharge channel 64, thus culminating in an increase in the flow resistance encountered by the drilling fluid in the direction of fluid flow. Therefore, as the number of recesses 86 and/or the degree of difference in TFA between each stage are increased, the flow resistance across the throat discharge channel 64 in the direction of flow is also increased. As the flow resistance across the throat discharge channel 64 in the direction of fluid flow is increased, the more the drilling fluid is restricted within the throat discharge channel 64, decreasing the amount of drilling fluid flowing into the throat discharge channel 64 while increasing the amount of drilling fluid flowing into the face discharge channels 34. In this manner, the amount of drilling fluid contacting the core 28 may be reduced. Moreover, this increased flow resistance across the throat discharge channel 64 in the direction of fluid flow may be accomplished while providing increased radial gap size $W_7$ and TFA within the recesses 86, reducing the likelihood that particulates or debris within the drilling fluid become lodged between the outer diameter 54 of the core shoe 42 and the inner surface 85 of the bit body 10 within the throat discharge channel 64 in a manner to cause rotational friction between the core bit 10 and the bit shoe 42, or worse, rotationally bind the core bit 6 to the core shoe 42 and cause failure of the core barrel assembly 2.

As shown in FIG. 6, the recesses 86 formed in the inner surface 85 of the bit body 10 located within the throat discharge channel 64 may have a rectangular shape when viewed in a longitudinal cross-sectional plane. The recesses 86 may extend in an annular pattern about a circumference of the inner surface 85 of the bit body 10. Alternatively, the recesses 86 may extend in a helical pattern about the inner surface 85 of the bit body 10. In other embodiments, the recesses 86 may have an arcuate shape when viewed in a longitudinal cross-sectional plane. In yet other embodiments, the recesses 86 may have other shapes.

Figure 7:
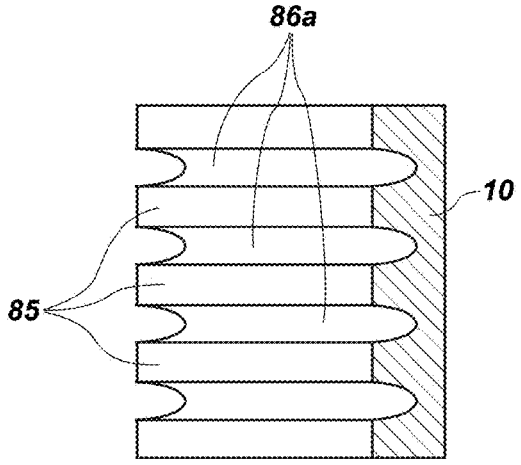
FIG. 7 illustrates a perspective view of a section of a bit body having longitudinal recesses formed in an inner surface thereof, according to an embodiment of the present disclosure.
Figure 8:
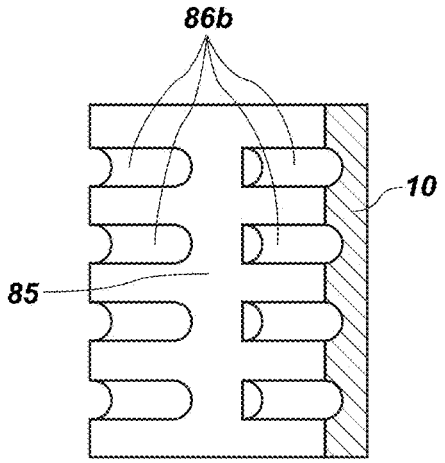
FIG. 8 illustrates a perspective view of a section of a bit body having longitudinal recess segments formed in an inner surface thereof, according to an embodiment of the present disclosure.
Figure 9:
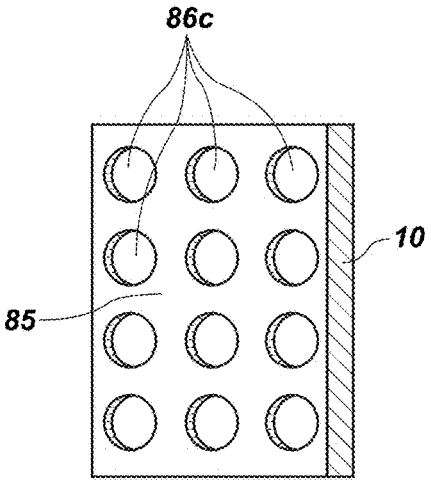
FIG. 9 illustrates a perspective view of a section of a bit body having an array of circular pockets formed in an inner surface thereof, according to an embodiment of the present disclosure.
Figure 10:
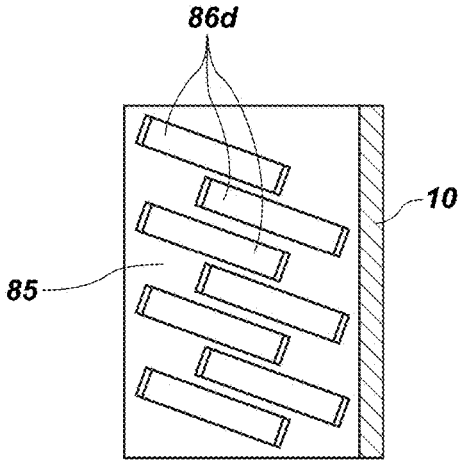
FIG. 10 illustrates a perspective view of a section of a bit body having rectangular recesses formed in an inner surface thereof, according to an embodiment of the present disclosure.

FIG. 6 illustrates one example of recesses 86 that may be employed to provide consecutive changes in TFA in the throat discharge channel 64. In other embodiments, the recesses 86 may have other shapes when viewed in a longitudinal cross-sectional plane. Additionally, recesses 86 may be formed in the outer surface 54*a* of the core shoe 42 surrounding the wedge-shaped portion 48 of the core catcher 46. In yet other embodiments, recesses 86 may be formed in the outer surface 54*a* of the core shoe 42 and an inner surface 85 of the core bit body 10 located within the throat discharge channel 64. In further embodiments, the recesses 86 may be in the form of longitudinally-extending channels 86*a*, as shown in FIG. 7. In additional embodiments, the recesses 86 may be in the form of longitudinally-extending channel segments 86*b*, as shown in FIG. 8. In other embodiments, the recesses 86 may be in the form of an array of circular pockets 86*c*, as shown in FIG. 9. In yet other embodiments, the recesses 86 may be in the form of an array of skewed rectangular pockets 86*d*, as shown in FIG. 10. It is to be appreciated that the shape, form, orientation and/or configuration of the recesses 86 is not limited by this disclosure.

Furthermore, in other embodiments, the series of consecutive TFA changes may be provided by forming a plurality of protrusions extending radially inward from the inner surface 85 of the bit body 10 and/or radially outward from the outer surface 54*a* of the core shoe 42 in the throat discharge channel 64. Such protrusions may be effectively configured as an inverse of any of the recesses 86-86*d* previously described, and may have other configurations as well. In yet other embodiments, the series of consecutive TFA changes may include a combination of recesses 86 and protrusions formed on or in the inner surface 85 of the bit body 10 and/or the outer surface 54*a* of the core shoe 42 in the throat discharge channel 64. Additionally, at least one of the recesses 86 and/or protrusions may vary in shape, form, orientation and/or configuration from at least one other groove 86 and/or protrusion.

It is to be appreciated that the throat discharge channel 64 may include any number of TFA changes provided by recesses 86 and/or protrusions formed on and/or in the inner surface 85 of the bit body 10 and the outer surface 54*a* of the first portion 42*a* of the core shoe 42 located within the throat discharge channel 64. For example, in the embodiment shown in FIG. 6, the throat discharge channel 64 has at least ten (10) TFA changes therein caused by the presence of five (5) recesses 86 formed in the inner surface 85 of the bit body 10. However, in other embodiments, other amounts of TFA changes may be appropriate or better suited for the throat discharge channel 64. It is to be appreciated that the maximum number of TFA changes in the throat discharge channel is virtually unlimited.

Additional, nonlimiting embodiments within the scope of this disclosure include:

Embodiment 1: A coring tool for extracting a sample of subterranean formation material from a well bore, comprising: a tubular body disposed within a bit body, a portion of the tubular body housing a core catcher, the tubular body and the bit body defining a fluid flow path therebetween; and at least one face discharge channel extending through the bit body from a face discharge channel inlet to a face of the bit body, the face discharge channel inlet in fluid communication with the fluid flow path, the face discharge channel inlet located longitudinally at or above the core catcher.

Embodiment 2:The coring tool of Embodiment 1, wherein the bit body comprises one of steel, a steel alloy, and an enhanced metal matrix.

Embodiment 3: The coring tool of Embodiment 1 or Embodiment 2, wherein an inner surface of the bit body and an outer surface of the tubular body define a throat discharge channel of the fluid flow path, the throat discharge channel extending longitudinally from the face discharge channel inlet to the face of the bit body, the throat discharge channel positioned radially inward of the at least one face discharge channel.

Embodiment 4:The coring tool of Embodiment 3, further comprising a series of changes in total flow area (TFA) in the throat discharge channel.

Embodiment 5:The coring tool of Embodiment 4, wherein the series of changes in TFA in the throat discharge channel comprises a plurality of recesses formed in at least one of the inner surface of the bit body and the outer surface of the tubular body within the throat discharge channel.

Embodiment 6: The coring tool of Embodiment 5, wherein the plurality of recesses is oriented one or more of annularly, helically, longitudinally, skewed and as an array of circular or rectangular pockets in the at least one of the inner surface of the bit body and the outer surface of the tubular body within the throat discharge channel.

Embodiment 7: The coring tool of any one of Embodiments 4 through 6, wherein the series of changes in TFA in the throat discharge channel comprises a plurality of protrusions formed on at least one of the inner surface of the bit body and the outer surface of the tubular body within the throat discharge channel.

Embodiment 8: The coring tool of Embodiment 7, wherein the plurality of protrusions is oriented one or more of annularly, helically, longitudinally, skewed and as an array of circular or rectangular protrusions on the at least one of the inner surface of the bit body and the outer surface of the tubular body within the throat discharge channel.

Embodiment 9: The coring tool of any one of Embodiments 4 through 8, wherein the series of changes in TFA in the throat discharge channel comprises: a plurality of recesses formed on one of the inner surface of the bit body and the outer surface of the tubular body within the throat discharge channel; and a plurality of protrusions formed on the other of the inner surface of the bit body and the outer surface of the tubular body within the throat discharge channel.

Embodiment 10: The coring tool of any one of Embodiments 4 through 8, wherein the series of changes in TFA in the throat discharge channel comprises: a plurality of recesses formed in the inner surface of the bit body and the outer surface of the tubular body within the throat discharge channel; and a plurality of protrusions formed on the inner surface of the bit body and the outer surface of the tubular body within the throat discharge channel.

Embodiment 11: A coring bit for extracting a sample of subterranean formation material from a well bore, the coring bit including a bit body, the bit body comprising: a bit face; an inner surface defining a substantially cylindrical cavity of the bit body, a first portion of the inner surface configured to surround a core catcher; at least one face discharge channel inlet formed in the inner surface of the bit body longitudinally at or above the first portion of the inner surface; and at least one face discharge channel extending through the bit body from the at least one face discharge channel inlet to the bit face.

Embodiment 12: The coring bit of Embodiment 11, wherein the bit body comprises one of steel, a steel alloy, and an enhanced metal matrix.

Embodiment 13: The coring bit of Embodiment 11 or Embodiment 12, further comprising a plurality of recesses formed in the inner surface of the bit body longitudinally downward of the at least one face discharge channel inlet.

Embodiment 14: The coring bit of Embodiment 13, wherein the plurality of recesses is oriented one or more of annularly, helically, longitudinally, skewed and as an array of circular or rectangular pockets in the inner surface of the bit body.

Embodiment 15: The coring bit of any one of Embodiments 11 through 14, further comprising a plurality of protrusions formed on the inner surface of the bit body longitudinally downward of the at least one face discharge channel inlet.

Embodiment 16: The coring bit of Embodiment 15, wherein the plurality of protrusions is oriented one or more of annularly, helically, longitudinally, skewed and as an array of circular or rectangular protrusions on the inner surface of the bit body.

Embodiment 17: A method of forming a coring bit for extracting a sample of subterranean formation material from a well bore, the method comprising: providing a bit body having a bit face and an inner surface, the inner surface defining a substantially cylindrical cavity of the bit body, a first portion of the inner surface configured to surround a core catcher; forming at least one inlet of a face discharge channel in the inner surface of the bit body at a location longitudinally at or above the first portion of the inner surface; and forming at least one face discharge channel extending through the bit body from the inlet to the bit face.

Embodiment 18: The method of Embodiment 17, wherein providing the bit body comprises selecting material of the bit body to comprises one of steel, a steel alloy, and an enhanced metal matrix.

Embodiment 19: The method of Embodiment 17 or Embodiment 18, further comprising forming a plurality of recesses in the inner surface of the bit body longitudinally downward of the at least one inlet.

Embodiment 20: The method of any one of Embodiments 17 through 19, further comprising forming a plurality of protrusions on the inner surface of the bit body longitudinally downward of the at least one inlet.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

What is claimed is:

1. A coring tool for extracting a sample of subterranean formation material from a well bore, comprising:

a tubular body disposed within a bit body and comprising:
an inner tube; and
a core shoe at an end of the inner tube and having a central bore configured to receive and guide a core into the inner tube;

a core catcher housed within the central bore of the core shoe; and at least one face discharge channel extending through the bit body from a face discharge channel inlet to a face of the bit body, the face discharge channel inlet in fluid communication with a fluid flow path defined by a space between the tubular body and the bit body and located longitudinally above a widest portion of the core shoe and proximate an upper end of the core catcher.

2. The coring tool of claim 1, wherein the bit body comprises one of steel, a steel alloy, and an enhanced metal matrix.

3. The coring tool of claim 1, wherein an inner surface of the bit body and an outer surface of the tubular body define a throat discharge channel of the fluid flow path, the throat discharge channel extending longitudinally from the face discharge channel inlet to the face of the bit body, the throat discharge channel positioned radially inward of the at least one face discharge channel.

4. The coring tool of claim 3, further comprising a series of changes in total flow area (TFA) in the throat discharge channel.

5. The coring tool of claim 4, wherein the series of changes in TFA in the throat discharge channel comprises a plurality of recesses formed in at least one of the inner surface of the bit body and the outer surface of the tubular body within the throat discharge channel.

6. The coring tool of claim 5, wherein the plurality of recesses are oriented one or more of annularly, helically, longitudinally, skewed and as an array of circular or rectangular pockets in the at least one of the inner surface of the bit body and the outer surface of the tubular body within the throat discharge channel.

7. The coring tool of claim 4, wherein the series of changes in TFA in the throat discharge channel comprises a plurality of protrusions formed on at least one of the inner surface of the bit body and the outer surface of the tubular body within the throat discharge channel.

8. The coring tool of claim 7, wherein the plurality of protrusions are oriented one or more of annularly, helically, longitudinally, skewed and as an array of circular or rectangular protrusions on the at least one of the inner surface of the bit body and the outer surface of the tubular body within the throat discharge channel.

9. The coring tool of claim 4, wherein the series of changes in TFA in the throat discharge channel comprises:

a plurality of recesses formed on one of the inner surface of the bit body and the outer surface of the tubular body within the throat discharge channel; and a plurality of protrusions formed on the other of the inner surface of the bit body and the outer surface of the tubular body within the throat discharge channel.

10. The coring tool of claim 4, wherein the series of changes in TFA in the throat discharge channel comprises:

a plurality of recesses formed in the inner surface of the bit body and the outer surface of the tubular body within the throat discharge channel; and a plurality of protrusions formed on the inner surface of the bit body and the outer surface of the tubular body within the throat discharge channel.

11. A coring bit for extracting a sample of subterranean formation material from a well bore, the coring bit comprising:

a bit body comprising:
a bit face;
an inner surface defining a substantially cylindrical cavity;

a tubular body within the substantially cylindrical cavity of the bit body and comprising:
an inner tube; and
a core shoe at an end of the inner tube and having an interior surface exhibiting a tapered portion;

a core catcher within the core shoe and exhibiting a wedge-shaped portion adjacent the tapered portion of the interior surface of the core shoe;

at least one face discharge channel inlet in the inner surface of the bit body longitudinally above a widest portion of the core shoe and proximate an upper end of the core catcher; and at least one face discharge channel extending through the bit body from the at least one face discharge channel inlet to the bit face.

12. The coring bit of claim 11, wherein the bit body comprises one of steel, a steel alloy, and an enhanced metal matrix.

13. The coring bit of claim 11, further comprising a plurality of recesses formed in the inner surface of the bit body longitudinally downward of the at least one face discharge channel inlet.

14. The coring bit of claim 13, wherein the plurality of recesses is oriented one or more of annularly, helically, longitudinally, skewed and as an array of circular or rectangular pockets in the inner surface of the bit body.

15. The coring bit of claim 11, further comprising a plurality of protrusions formed on the inner surface of the bit body longitudinally downward of the at least one face discharge channel inlet.

16. The coring bit of claim 15, wherein the plurality of protrusions is oriented one or more of annularly, helically, longitudinally, skewed and as an array of circular or rectangular protrusions on the inner surface of the bit body.

17. A method of forming a coring bit for extracting a sample of subterranean formation material from a well bore, the method comprising:

providing a bit body having a bit face and an inner surface defining a substantially cylindrical cavity of the bit body;

forming at least one inlet of a face discharge channel in the inner surface of the bit body;

forming at least one face discharge channel extending through the bit body from the at least one inlet to the bit face;

providing a tubular body within the substantially cylindrical cavity of the bit body, the tubular body comprising an inner tube and a core shoe at an end of the inner tube, the core shoe having an interior surface exhibiting a tapered portion, and a widest portion of the core shoe located longitudinally below the at least one inlet of the face discharge channel; and providing a core catcher within the core shoe at a location longitudinally at or below the at least one inlet of the face discharge channel and exhibiting a wedge-shaped portion adjacent the tapered portion of the interior surface of the core shoe.

18. The method of claim 17, wherein providing the bit body comprises selecting material of the bit body to comprise one of steel, a steel alloy, and an enhanced metal matrix.

19. The method of claim 17, further comprising forming a plurality of recesses in the inner surface of the bit body longitudinally downward of the at least one inlet.

20. The method of claim 17, further comprising forming a plurality of protrusions on the inner surface of the bit body longitudinally downward of the at least one inlet.

* * * * *